United States Patent [19]

Shea

[11] 4,133,337

[45] Jan. 9, 1979

[54] OVEN LATCH ASSEMBLY WITH IMPROVED HIGH TEMPERATURE LOCKING SUB-ASSEMBLY

[75] Inventor: Christopher J. Shea, New Britain, Conn.

[73] Assignee: The Stanley Works, New Britain, Conn.

[21] Appl. No.: 833,235

[22] Filed: Sep. 14, 1977

[51] Int. Cl.[2] ..... F24C 15/02

[52] U.S. Cl. ..... 126/197; 292/113; 292/210

[58] Field of Search ..... 126/197, 273; 292/108, 292/113, 153, 196, 210, 223, 242, DIG. 31, DIG. 66, DIG. 69

[56] References Cited

U.S. PATENT DOCUMENTS

| | | | |
|---|---|---|---|
| 3,406,677 | 10/1968 | Anderson | 126/197 |
| 3,438,666 | 4/1969 | Erickson | 126/273 |
| 3,469,568 | 9/1969 | Torrey et al. | 126/39 C |
| 3,540,767 | 11/1970 | Champion | 126/197 |

*Primary Examiner*—John J. Camby
*Assistant Examiner*—Larry I. Schwartz

[57] ABSTRACT

A latch for ovens and the like includes a latch subassembly movable between latching and unlatching positions, a high temperature locking pawl which is engageable with the latch subassembly at a preselected elevated temperature to block its movement to unlatching position, and a thermal element which rotates the pawl into the blocking position. Resiliently deflectable means is provided on the locking pawl to rotate the pawl into blocking position in the event that the latch subassembly is moved from the latched position towards the unlatched position as the preset elevated temperature for latching is approached, thereby compensating for lag in response of the thermal element and preventing opening of the oven door at elevated temperatures.

7 Claims, 9 Drawing Figures

OVEN LATCH ASSEMBLY WITH IMPROVED HIGH TEMPERATURE LOCKING SUB-ASSEMBLY

BACKGROUND OF THE INVENTION

Many kitchen and commercial stoves now incorporate a self-cleaning feature in which the heat producing means can be activated to generate a very high temperature within the oven so as to produce substantially complete combustion of organic deposits upon the surfaces of the oven. Such temperatures frequently run as high as 380° Centigrade and above.

To ensure against inadvertent opening of the oven door while the oven is at elevated temperatures, a manual latch has been employed to latch the oven door in closed position, thus requiring a physical act in addition to grasping the handle of the door. However, concerns for user safety have led to the incorporation of various additional elements for latching the door in closed position during the high temperature portion of the cleaning cycle. Some such devices have used electrical interconnections between a solenoid engagable with the latch mechanism and the circuitry controlling the high temperature phase of the appliance, particularly in the instance of electric ovens. Another approach has been the incorporation of a bimetallic strip responsive to the temperature in the oven and effective to move a pawl into a blocking position with respect to the latch subassembly, thereby preventing its movement from latched position to unlatched position when the bimetallic strip is exposed to preselected elevated temperatures. A device of this type is disclosed and described in detail in Erickson U.S. Pat. No. 3,438,666 granted Apr. 15, 1969.

To compensate for the temperature lag generally experienced between the temperature in the oven and that in the recess in which the bimetallic strip is disposed and the time lag between exposure of the bimetallic strip to the temperature and the resultant movement of the blocking pawl during the cooling portion of the cycle, Siegel U.S. Pat. No. 3,540,767 granted Nov. 17, 1970 discloses and describes a clutch assembly in the operative connection between the bimetallic strip and the blocking pawl. As the blocking pawl rotates towards blocking position, it stops at a preselected point representing less rotation than that which might be effected by the bimetallic strip during the full heating cycle and there then occurs slippage as the bimetallic strip continues to expand. When the bimetallic strip begins to cool, it immediately begins to effect movement of the blocking pawl, thus compensating for the temperature lag since the amount of relative slippage may be controlled for the temperature lag experienced in a particular oven by proper dimensioning of the parts.

However, it has been found that there nevertheless remains a problem area with respect to the time lag between the action of the bimetallic strip upon the blocking pawl and the actual temperatures within the oven. As the abument surface upon the blocking pawl approaches the point at which it would obstruct movement of the latch subassembly, movement of the latch subassembly from its latched to unlatched positions will tend to cam the blocking pawl away from a blocking position since the forces are sufficiently great to overcome the clutch.

It is an object of the present invention to provide an improved latch for ovens and the like with a high temperature latching subassembly compensating for the lag in action by the temperature sensing element as the locking position is approached.

It is also an object to provide such a latch wherein said compensating means is operative only within a narrow range of temperature and may be bypassed during operation of the latching subassembly at lower temperatures.

Another object is to provide such a latch which may be simply and readily fabricated and which is rugged and durable in operation.

SUMMARY OF THE INVENTION

It has now been found that the foregoing and related objects may be readily attained in a latch for ovens and the like which includes a support and a latch subassembly movable on the support between latching and unlatching positions. A high temperature locking pawl has an abutment surface thereon engagable with the latch subassembly to block its movement from latching to unlatching position, and means is provided for rotatably mounting the pawl on the support.

A thermal element is operatively connected to the locking pawl and is responsive to elevated temperatures in the oven to rotate the pawl from a first position wherein its abutment surface is removed from the path of movement of the latch subassembly from latching position to unlatching position and to a second position wherein its abutment surface is disposed in the path of movement of the latch subassembly so as to block its movement into unlatching position. This thermal element is responsive to subsequent decline in temperature within the oven to move the pawl from the second position to its first position.

Resiliently deflectable means is provided on the locking pawl spaced from its axis of rotation to the side opposite that axis from the abutment surface thereon. The latch subassembly has a surface which is engagable with the deflectable means as the locking pawl approaches its second position and when the latch subassembly is moved towards unlatching position. This engagement of the surface on the latch subassembly and the deflectable means effect rotation of the pawl about its axis of rotation so as to dispose its abutment surface in its second position and thereby prevent further movement of the latch subassembly into unlatching position. At conditions of lower temperatures, the deflectable means is deflectable by the latch subassembly without substantial rotation of the locking pawl so as to permit free movement of the latch subassembly between latching and unlatching positions.

In accordance with the preferred embodiment of the present invention, the rotatable mounting means for the pawl permits its free rotation and the operative connection between the pawl and the thermal element includes clutch means which is operative to permit movement of the pawl independently of movement of the thermal element. Desirably, this comprises a shaft about which the pawl is freely rotatable and which is operatively connected to the thermal element so that it is rotated by heating and cooling of the thrmal element. A member is fixedly mounted on the shaft and extends along one horizontal surface of the pawl, and means is provided to resiliently bias the pawl against the member so as to produce frictional engagement therebetween. As a result, the pawl will normally move with the member upon rotation of the shaft in response to action of the thermal element, but the pawl is movable independently of the member by engagement of the deflectable means with the surface on the latch subassembly so that the biasing pressure maintaining the frictional engagement between the member and pawl is overcome.

Most desirably, the deflectable means comprises a coil spring extending substantially perpendicularly to the surface of the locking pawl in its normal position. The abutment surface on the locking pawl comprises a tab extending parallel to the axis of rotation and spaced therefrom. The latch subassembly includes a portion which is pivotable over the locking pawl in movement between latching and unlatching positions and this portion is engageable with the resiliently deflectable means.

DETAILED DESCRIPTION OF THE ILLUSTRATED EMBODIMENT

Figure 1:
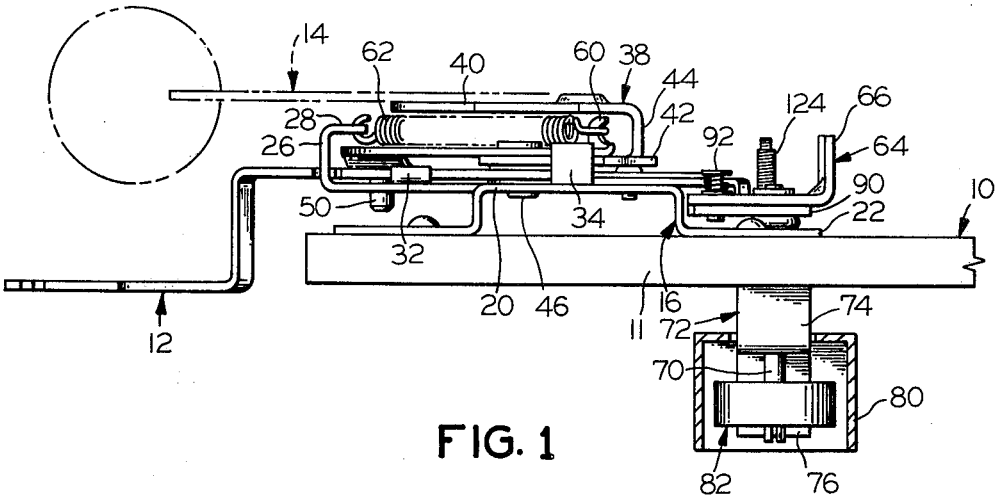
FIG. 1 is a side elevational view of an oven latch assembly employing the improved high temperature locking subassembly of the present invention with the handle shown in phantom line and with a portion of the appliance housing being fragmentarily illustrated.
Figure 2:
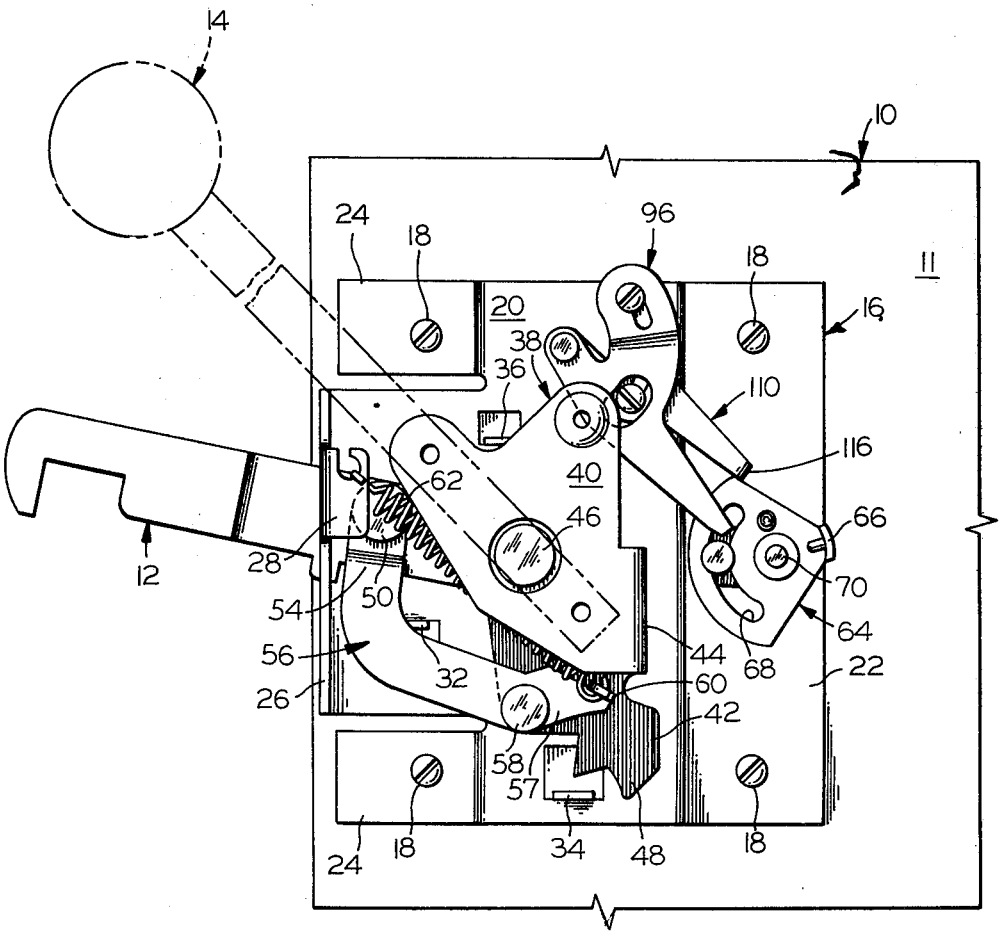
FIG. 2 is a top plan view of the assembly with the operating parts in the unlatched condition.

Turning now to the attached drawings in detail, FIGS. 1 and 2 illustrate the improved oven latching assembly of the present invention which is mounted upon a fragmentarily illustrated horizontal wall 11 of the appliance body generally designated by the numeral 10. As is customary, the wall 11 is spaced above the oven cavity (not shown). The handle generally designated by the numeral 14 is fragmentarily illustrated in phantom line and projects outwardly of the appliance body 10 above the oven door (not shown) and is used to mechanically move the latch arm generally designated by the numeral 12 into and from engagement with a strike plate (not shown) in the oven door (not shown).

The latch assembly includes the support plate generally designated by the numeral 16 which is secured to the wall 11 of the appliance body 10 by a plurality of fasteners 18. The support plate 16 is stamped or otherwise formed to provide an elevated platform portion 20 extending parallel to and spaced from the wall 11 of the appliance body 10. Along the end thereof spaced from the oven door (not shown), is a depending L-shaped flange 22 which seats upon the wall 11 and at the opposite end thereof are a pair of depending L-shaped legs 24 which also seat upon the wall 11, thus providing the means for securing the support plate 16 to the wall 11 by the fasteners 18. At the end of the platform portion 20 adjacent the door (not shown) is an upstanding wall 26 with a reversely bent finger 28 extending away from the door (not shown). The upstanding wall 26 has an elongated horizontally extending slot (not shown) through which the latch arm 12 extends and providing for pivotal movement thereof between the positions shown in FIGS. 2 and 3.

The metal of the platform portion 20 is staked upwardly to provide a series of three upstanding abutments 32,34,36 to limit movement of parts as described more fully hereinafter.

Disposed upon the support plate 16 is the operating lever generally designated by the numeral 38 which includes a top plate 40, a bottom plate 42 extending parallel thereto and a U-shaped connecting web 44 at the end thereof spaced from the oven door (not shown). The bottom plate 42 includes an abutment arm portion 48 and is pivotally mounted upon the platform portion 20 of the support plate 16 by the pivot pin or rivet 46.

The latch arm 12 has an elongated slot (not shown) through which the pivot pin 46 extends to provide a sliding pivot connection therebetween and the platform portion 20 is provided with an arcuate slot (not shown) adjacent the upstanding wall 26 in which there is slidably disposed the depending cam follower pin 50 on the latch arm 12 to permit the controlled latching movement of the latch arm 12 during operation of the toggle mechanism.

Pivotally connected to the latch arm 12 by the cam follower pin 50 is one arm 54 of the toggle generally designated by the numeral 56. The other arm 57 is pivotally connected to the bottom plate 42 of the operating lever 38 by the pivot pin or rivet 58, and an upstanding finger 60 is provided on the end thereof. A tension spring 62 has one end thereof engaged with the upstanding finger 60 and the other end thereof engaged with the finger 28 on the upstanding wall 26 of the support plate 16. Thus, it can be seen that a toggle action is provided upon movement of the handle 14 to accelerate movement of the latch arm 12 into either open or latched positions and to apply substantial biasing pressure in either of such positions.

The general structure and operation of this type of mechanism is more fully described and illustrated to U.S. Pat. No. 3,438,666 granted Apr. 15, 1969 to K.H. Erickson.

Figure 4:
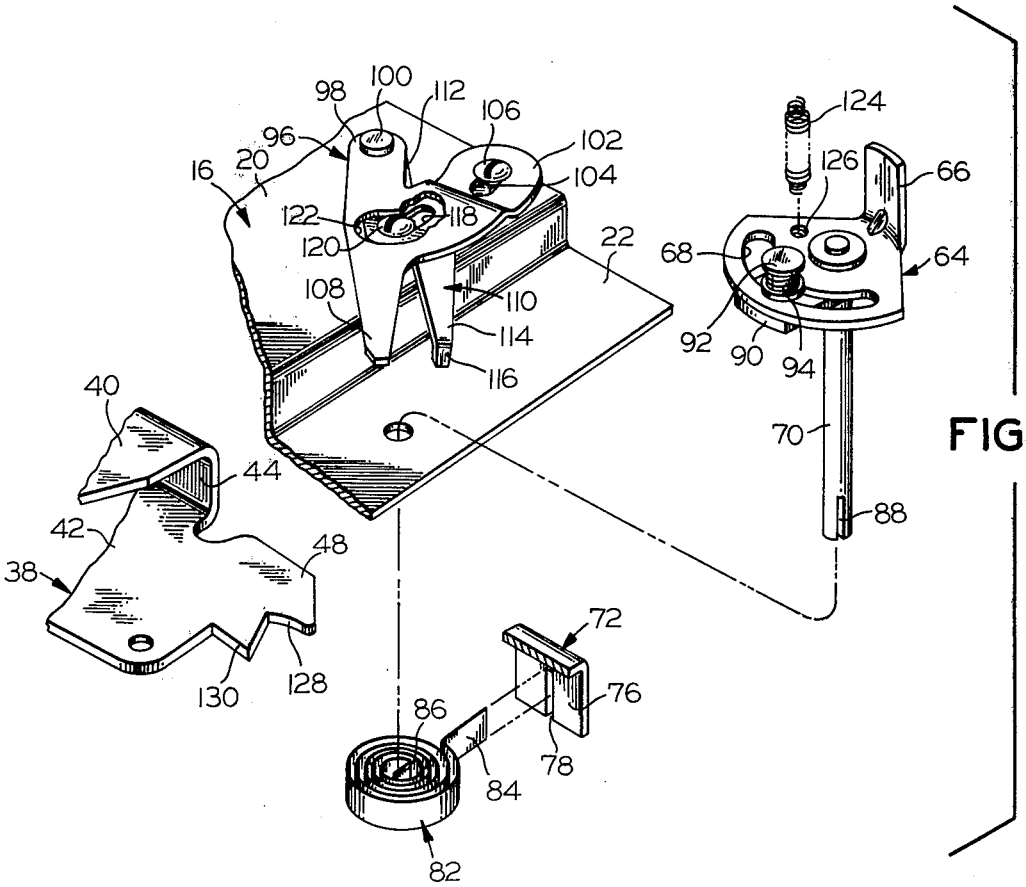
FIG. 4 is a fragmentary and partially exploded view of the high temperature locking subassembly, drawn on an enlarged scale.

As previously indicated, the oven latch assembly of the present invention employs an improved high temperature locking subassembly of the general type originally disclosed in the aforesaid Erickson Patent and modified in U.S. Pat. No. 3,540,767 granted Nov. 17, 1970 to Charles L. Siegel. As in the case of the devices of the two prior patents, a blocking pawl generally designated by the numeral 64 is rotatably mounted on the upper end of the shaft 70 and includes an upstanding abutment arm 66 at one side thereof and an arcuate slot 68 adjacent the other side thereof. The shaft 70 extends through the support plate 16 and the wall 11 of the appliance body 10 and is journaled in the L-shaped mounting portion 74 of the support member generally designated by the numeral 72. The support member 72 also includes a reversely oriented L-shaped arm portion 76 extending laterally of the lower end of the shaft 70 with a perpendicularly extending slot 78 in the end thereof, as best seen in FIG. 4.

Disposed about the lower end of the shaft 70 on the horizontal surface of the arm portion 76 of the support member 72 is a coiled bimetallic strip generally designated by the numeral 82 having a linear outer end portion 84 engaged within the slot 78 of the support member 72. The inner end portion 86 of the bimetallic strip 82 is engaged in the axially extending slot 88 in the lower end of the shaft 70. A housing 80 is provided about the bimetallic strip 82 and has an open bottom so that it is readily exposed to the operating temperatures within the oven chamber (not shown) with which it is in communication. As a result, expansion of the bimetallic strip 82 occurring during heating will produce counterclockwise rotation of the shaft 70 as seen from above the shaft 70 since the outer end portion 84 is trapped, and cooling will produce clockwise rotation.

Nonrotatably mounted upon the upper end portion of the shaft 70 below the blocking pawl 64 is a clutch arm or plate 90 which extends under the arcuate slot 68. A headed pin 92 has its head portion disposed above the blocking pawl 64 and its shank portion extending downwardly through the arcuate slot 68 therein and fixed in the clutch plate 90. A compression spring 94 is disposed about the shank portion of the pin 92 and acts between the head portion thereof and the upper surface of the blocking pawl 64 about the slot 68 therein. As a result, the blocking pawl 64 is is biased firmly against the clutch plate 90 so as to produce frictional engagement therewith, whereby rotation of the shaft 70 and clutch plate 90 will normally produce equivalent rotation of the blocking pawl 64 although it is freely rotatable upon the shaft 70.

Supported upon the platform portion 20 of the support plate 16 is a locking temperature adjustment lever generally designated by the numeral 96 having a pivot end portion 98 pivotally mounted upon the support plate 16 by the pivot pin 100 and an abutment arm portion 108 at its other end. An arcuate arm portion 102 extends in the general direction of the pivot end portion 98 and has a downwardly offset section slidable on the support plate 16 and provided with an arcuate slot 104. Extending through the slot 104 and rotatably engaged in the support plate 16 is an adjustment screw 106 which secures the locking temperature adjustment lever 96 in any adjusted position thereof. As a result, the abutment arm portion 108 of the adjustment lever 96 may be disposed at a preselected position in the path of movement of the abutment arm 66 of the blocking pawl 64.

Disposed between the locking temperature adjustment lever 96 and the support plate 16 and slidable upon the support plate 16 is the unlocking temperature adjustment lever generally designated by the numeral 110 and having a pivot end portion 112 through which the pivot pin 100 extends. At its opposite end is an abutment arm portion 114 having a downwardly extending stop 116 for engagement with the side edge of the blocking pawl 64 as it rotates in the clockwise direction. An adjusting screw 120 is disposed within the slot 118 of the unlocking temperature adjustement lever 110 so as to secure it in the desired pivoted position thereof, and the locking temperature adjustment lever 96 is provided with an enlarged slot 122 so as to permit free movement about the head of the screw 120.

The blocking pawl 64 also has a coil spring 124 threadably engaged in the aperture 126 thereof and projecting upwardly therefrom. This spring 124 cooperates with the cam shoulder 130 on the abutment arm portion 48 of the operating arm lever 38 so as to effect rotation of the blocking pawl 64 under certain conditions to bring the abutment arm 66 into blocking relationship with the latch shoulder 128 on the abutment arm portion 48 of the operating lever 38 as will be described more fully hereinafter.

In normal operation of a stove embodying the latch assembly of the present invention, the latch mechanism will be in the position illustrated in FIG. 2. In this position, the latch arm 12 will not engage with the strike plate (not shown) of the oven door (not shown) so that the door may be opened and closed readily. Although the bimetallic strip 82 effects rotation of the shaft 70 and thereby the blocking pawl 64, the abutment arm 66 thereon will not engage the operating lever 38.

However, when it is desired to latch the oven door (not shown) in closed position, the handle 14 is moved from its phantom line position shown in FIG. 2 in a direction towards the bottom of the page as seen therein. This will effect operation of the toggle mechanism provided by the combination of the operating lever 38, toggle 56, and toggle spring 62 to produce the toggle action and move the operating lever 38 and latch arm 12 into the position shown in FIGS. 3 and 5. In this position, the operating lever 38 is limited from further rotation by the abutment 36. As will be readily appreciated, the latch arm 12 is firmly engaged with the strike plate (not shown) of the oven door (not shown) and its movement into this position is also somewhat inwardly relative to the support plate 16 so as to draw the door (not shown) inwardly and tightly against the door opening (not shown) of the appliance body 10.

Figure 3:
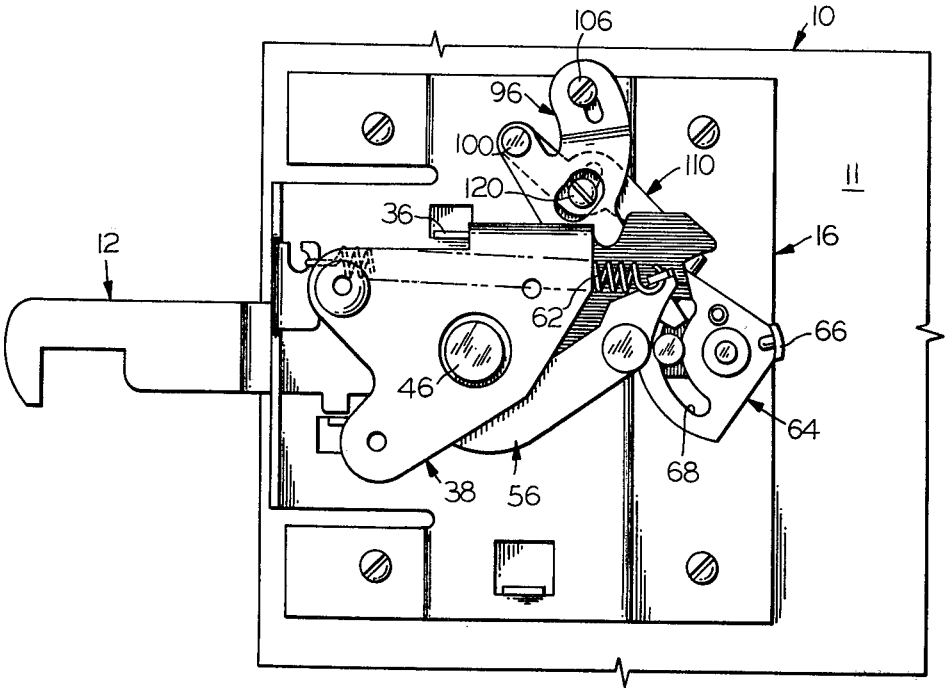
FIG. 3 is a view similar to FIG. 2 showing the operating parts moved into mechanical latching position but before the high temperature locking subassembly has been engaged.
Figure 5:
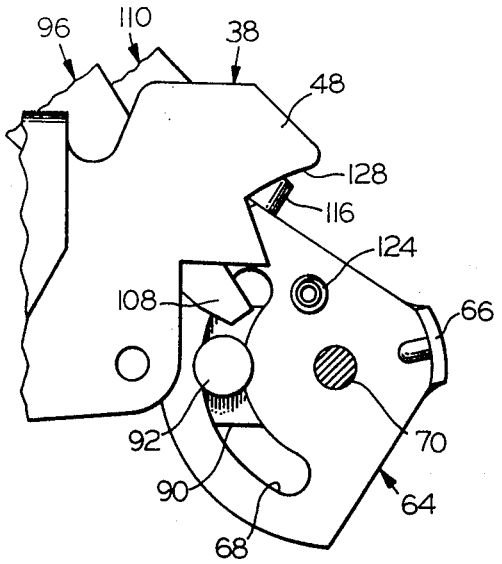
FIG. 5 is a partially diagrammatic view of the high temperature locking subassembly in the initial latched position of FIG. 3.
Figure 7:
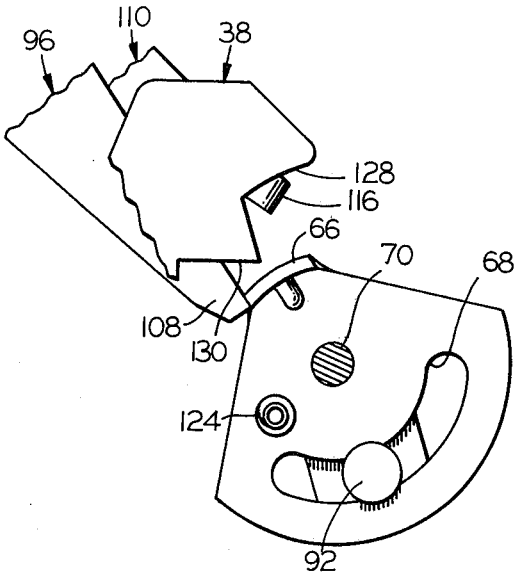
FIG. 7 is a similar view showing the high temperature locking pawl fully rotated into high temperature locking position and abutting the high temperature adjustment temperature lever.
Figure 6:
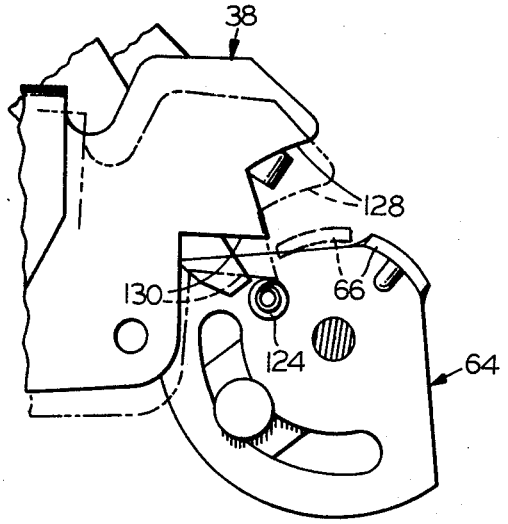
FIG. 6 is a similar view showing the high temperature locking pawl partial rotated and showing in phantom line a position of abutment arm portion of the operating lever if it is moved towards a door opening position.

With the latch arm 12 and operating lever 38 in the position shown in FIGS. 3 and 5, development of a high temperature in the oven will cause the bimetallic strip 82 to expand and produce rotation of the blocking pawl 64 in a counterclockwise direction as is shown in FIG. 6. As will be appreciated, the spring 94 is maintaining the clutch plate 90 and blocking pawl 64 in frictional engagement to effect this rotation of the blocking pawl 64. During continued rotation, the abutment arm 66 abuts against the abutment arm portion 108 of the locking temperature adjustment lever 96 as is seen in FIG. 7. At this point, the abutment arm 66 is positioned so as to prevent movement of the operating lever 38 and thereby the latch arm 12 into the door opening position of FIG. 2 since the shoulder 128 or the shoulder 130 on the lever 38 (depending upon the stop position established) will strike against and be restrained from further movement by the abutment arm 66.

Figure 8:
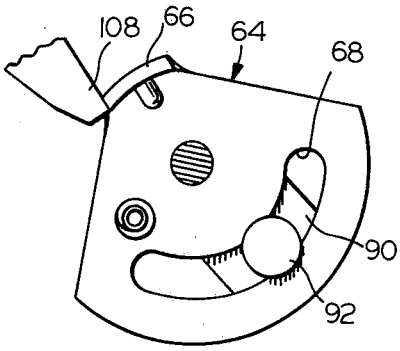
FIG. 8 is a view showing the effect of continued expansion of the bimetal to produce movement of the clutch assembly.

Continued expansion of the bimetallic strip 82 will continue to effect rotation of the shaft 70 and thereby the clutch plate 90. However, the biasing pressure of the spring 94 will be overcome, and the pin 92 will slide in the slot 68 in the blocking pawl 64 as is shown in FIG. 8.

This principle of operation is discussed in detail in the aforementioned Siegel patent and is used to compensate for the lag between cooling of the oven and contraction of the bimetallic strip 82 since the blocking pawl 64 will begin to rotate almost immediately upon cooling.

As will be appreciated, the rotation of the blocking pawl 64 into blocking position will lag somewhat behind the temperature in the oven and it is desirable to preclude opening of the oven door (not shown) as the temperatures approach the preset latching temperature. As can be seen in FIG. 6, movement of the operating lever 38 from its full line latched position towards the opening position shown in phantom line will cause the cam shoulder 130 to bear against the upstanding spring 124 upon the blocking pawl 64. As a result, this engagement will rotate the blocking pawl 64 into a position where the abutment arm 66 is disposed in the path of the latch shoulder 128 upon the operating lever 38, thus precluding its movement suffiently to reverse the toggle mechanism and release the latch arm 12.

Figure 9:
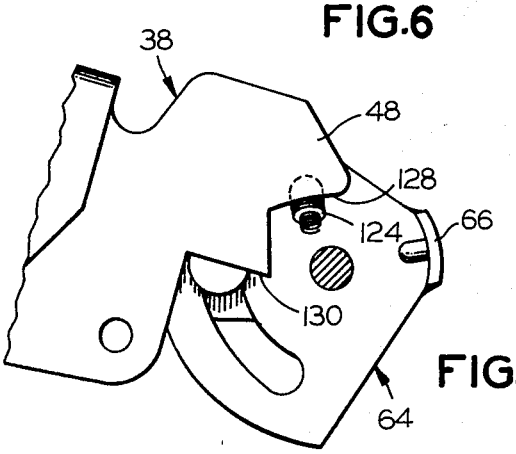
FIG. 9 is a similar view showing deflection of the deflectable stop spring during the opening and closing movement of the latch at low temperature conditions.

As seen in FIG. 9, at low temperature conditions, the spring 124 is sufficiently deflectable as to be bent downwardly by the latch shoulder 128 to permit the operating lever 38 to move thereby in the direction of opening or closing.

As explained in detail in the aforementioned Siegel patent, it is desirable to limit the amount of rotation of the blocking pawl 64 in response to expansion of the bimetallic strip 82 so that there will not be an excessive time lag between cooling of the oven to a temperature at which the door may be safely opened and the time when the abutment arm 66 will be moved from a position interfering with movement of the operating lever 38 to an opening position. Accordingly, as suggested in the aforementioned Siegel patent, the assembly of the present invention employs the locking temperature adjustment lever 96 against which the abutment arm 66 of the blocking pawl 64 abuts when the desired temperature of latching has been reached. Thereafter, further motion of the bimetallic strip 82 is absorbed by the relative motion between the clutch plate 90 and blocking pawl 64 as hereinbefore described. The positioning of the locking temperature adjustment lever 96 can be readily adjusted by loosening the adjustment screw 106, pivoting the lever 96 to the desired position, and tightening the adjustment screw 106 to maintain it in that position.

However, the assembly of the present invention also includes means for limiting the rotation of the blocking pawl 64 in the clockwise direction during cooling of the bimetallic strip 82. This feature is provided by the unlocking temperature adjustment lever 110 which may be pivoted about the pivot pin 100 into a range of positions in the path of clockwise movement of the blocking pawl 64 so that its stop 116 will engage the leading edge of the blocking pawl 64 in such clockwise movement and thereby prevent further clockwise rotation. Continued cooling of the bimetallic strip 82 and thereby rotation of the shaft 70 will be accommodated by sliding of the clutch pin 92 within the slot 68 of the blocking pawl 64.

Varying the pivoted locations of the locking temperature adjustment lever 96 and unlocking temperature adjustment lever 110 will vary the amount and path of oscillation of the blocking pawl 64 and thereby its abutment arm 66. Since movement of the blocking pawl 64 in the counterclockwise direction from the unlocking temperature adjustment lever 110 will be effected immediately upon rotation of the shaft 70 by the bimetallic strip 82 during heating, and conversely, since the movement of the blocking pawl 64 in a clockwise direction will occur immediately upon contraction of the bimetallic strip 82 during cooling, the positioning of these two levers enables adjustment of the latch assembly to render it effective for a wide variety of ovens with different heating and cooling rates and different lags in temperature response by the bimetallic strip 82.

As previously indicated, the provision of the resiliently deflectable means in the form of the coil spring 124 affords significant advantages from a safety standpoint since it will operate to move the blocking pawl 66 into effective position as the high temperatures in the oven are approached. The location of the spring 124 on the horizontal surface of the pawl 64 may vary but it will be generally to the side of the axis of rotation of the shaft 70 opposite from that upon which the abutment 66 is disposed in order to facilitate pivoting in the counterclockwise direction.

In the illustrated embodiment, both adjustment levers are elongated and pivoted upon the support plate adjacent one end so that they pivot into their various adjusted positions. However, it will be readily appreciated that the adjustment levers may be slidable in the desired direction of movement to achieve the desired result. Moreover, if so desired, the two levers may be movable together or independently by provision of suitable means for releasably locking the two levers together.

As will be readily appreciated, other configurations and constructions for the several specifically illustrated elements may be employed while achieving the desired result. Desirably, the several components are fabricated from metals which are adapted to withstand repeated heat cycling, and the parts may be readily fabricated by stamping and punching from such metals.

The latches of the present invention may be utilized with a variety of ovens made by different manufacturers and utilizing different forms of energy and they may also be employed in different models of the same manufacturer since there is incorporated means for effecting adjustment of the locking and unlocking positions of the blocking pawl for any given oven. To establish the positions of the adjustment levers and thereby the pawl at its two points of movement, a latch may be incorporated in a test appliance and the oven heated to a preselected temperature to establish the position of the pawl in response to actuation of the bimetallic element by the temperature within the oven. The first adjustment lever is then set to stop the pawl from further rotation at this point. Since the initial position of the blocking pawl may be noted, the second adjustment lever may be utilized to establish the unlocking temperature position of the pawl and thereby to determine the amount of rotation of the pawl between its two positions. It will be appreciated that variations of the procedure may be employed if so desired.

From the foregoing detailed specification and drawings, it will be appreciated that the latch of the present invention thus provides a high temperature latch subassembly readily compensating for the lag in action by the temperature sensing element as the locking position is approached, since the resiliently deflectable member will produce rotation into the blocking position. However, the resiliently deflectable member is operative only within a narrow range of temperatures so that it may be bypassed during operation of the latch subassembly at lower temperatures. The various components of the latch are all simply and readily fabricated and the resultant latch is rugged and durable in operation.

Having thus described the invention, I claim:

1. A latch for ovens and the like comprising:

A. a support;

B. a latch subassembly movable on said support between latching and unlatching positions;

C. a high temperature locking pawl having an abutment surface thereon engagable with said latch subassembly to block it movement from latching to unlatching position;

D. means rotatably mounting said pawl on said support;

E. a thermal element operatively connected to said locking pawl and responsive to elevated temperatures to rotate said pawl from a first position wherein said abutment surface is removed from the path of movement of said latch subassembly from latching position to unlatching position to a second position wherein said abutment surface is disposed in said path of movement of said latch subassembly to block its movement into unlatching position, said thermal element being responsive to subsequent decline in temperature to move said pawl from said second position to said first position; and F. resiliently deflectable means on said locking pawl spaced from the axis of rotation thereof to the opposite side from said abutment surface, said latch subassembly having a surface thereon engagable with said deflectable means as said locking pawl approaches said second position and when said latch subassembly is moved towards unlatching position, said engagement of said surface and said deflectable means effecting rotation of said pawl about its axis of rotation to dispose said abutment surface in said second position and thereby prevent further movement of said latch subassembly into unlatching position, said deflectable means being deflectable by said latch subassembly at conditions of lower temperature so as to permit free movement of said latch subassembly between latching and unlatching positions.

2. The latch in accordance with claim 1 wherein said means rotatably mounting said pawl on said support permits free rotation of said locking pawl and wherein the operative connection between said locking pawl and said thermal element includes clutch means operative to permit movement of said pawl independently of said thermal element.

3. The latch in accordance with claim 1 wherein said means rotatably mounting said pawl on said support includes a shaft about which said pawl is freely rotatable, and operatively connected to said thermal element which effects rotation of said shaft upon heating and cooling thereof, a member fixedly mounted on said shaft and extending along one horizontal surface of said pawl, and means resiliently biasing said pawl against said member to produce frictional engagement therebetween whereby said pawl will normally move with said member upon rotation of said shaft in response to action of said thermal element, said pawl being movable independently of said member by engagement of said surface on said latch subassembly with said deflectable means whereby the biasing pressure maintaining frictional engagement therebetween is overcome.

4. The latch in accordance with claim 1 wherein said deflectable means comprise a coil spring extending substantially perpendicularly to the surface of said locking pawl in the normal position thereof.

5. The latch in accordance with claim 1 wherein said abutment surface on said locking pawl comprises a tab extending parallel to the axis of rotation thereof and spaced therefrom.

6. The latch in accordance with claim 1 wherein said latch includes means for adjusting and predetermining the path of movement of said pawl between said first and second positions.

7. The latch in accordance with claim 1 wherein said deflectable means comprises a coil spring extending substantially perpendicularly to and upwardly from the surface of said locking pawl in the normal position thereof, and wherein said latch subassembly includes a portion pivotable over said locking pawl in movement between latching and unlatching positions, said portion being engagable with said resiliently defectable means.

* * * * *